US012747525B2

(12) United States Patent
Rosenberg et al.

(10) Patent No.: US 12,747,525 B2
(45) Date of Patent: Sep. 29, 2026

(54) WARP KNIT AND BRAIDED FABRICS WITH ELECTRICAL COMPONENTS

(71) Applicant: Apple Inc., Cupertino, CA (US)

(72) Inventors: Andrew L Rosenberg, Sunnyvale, CA (US); Kathryn P Crews, Menlo Park, CA (US); Didio V Gomes, Sunnyvale, CA (US); Benjamin J Grena, San Francisco, CA (US); Maurice P May, Sunnyvale, CA (US); Daniel A Podhajny, Morgan Hill, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 18/734,475

(22) Filed: Jun. 5, 2024

(65) Prior Publication Data

US 2024/0417898 A1 Dec. 19, 2024

Related U.S. Application Data

(60) Provisional application No. 63/507,887, filed on Jun. 13, 2023.

(51) Int. Cl.

| | |
|---|---|
| ***D04C 1/02*** | (2006.01) |
| ***D04C 3/14*** | (2006.01) |
| ***D04C 3/48*** | (2006.01) |

(52) U.S. Cl.

CPC ..... *D04C 1/02* (2013.01); *D04C 3/14* (2013.01); *D04C 3/48* (2013.01); *D10B 2401/16* (2013.01); *D10B 2401/18* (2013.01)

(58) Field of Classification Search

CPC ... D04C 1/02; D04C 3/14; D04C 3/48; D10B 2401/18

See application file for complete search history.

(56) References Cited

U.S. PATENT DOCUMENTS 2,541,728 A * 2/1951 Wahl ..... A44B 19/42 72/142
5,012,125 A * 4/1991 Conway ..... H01F 27/34 336/229
6,329,917 B1 * 12/2001 Leonard ..... G08B 13/2454 340/572.7

(Continued)

FOREIGN PATENT DOCUMENTS

WO WO-2021263086 A1 * 12/2021 ..... D04C 3/20

*Primary Examiner* — Shaun R Hurley

(74) *Attorney, Agent, or Firm* — Treyz Law Group, P.C.; Kendall P. Woodruff

(57) ABSTRACT

Knitting equipment may be used to form warp knit fabric. The warp knit fabric may be a spacer fabric having a spacer strand that travels back and forth between outer warp knit layers. The spacer fabric may include a pocket for receiving an electrical component. The electrical component may be mounted to an inlaid conductive strand that floats between the outer warp knit layers and that is held in place by the spacer strand. The pocket may be one of multiple pockets in the spacer fabric that are separated from one another by the spacer strand. Braiding equipment may include carriers that braid strands around an electrical component while a tool holds the electrical component in place. A ring may be used to isolate the braiding angle from the carriers to accommodate component insertion. The electrical component may be mounted to an inlaid conductive strand in the braid.

15 Claims, 13 Drawing Sheets

(56) References Cited

U.S. PATENT DOCUMENTS 6,957,525 B2 * 10/2005 Verstraeten ..... D02G 3/12 57/238
7,144,830 B2 * 12/2006 Hill ..... D03D 1/0088 442/205
7,348,285 B2 3/2008 Dhawan et al.
7,592,276 B2 * 9/2009 Hill ..... D03D 15/258 313/511
7,923,390 B2 * 4/2011 Burke ..... H01B 13/225 428/606
8,116,898 B2 2/2012 Chung et al.
8,476,172 B2 7/2013 Christof
8,505,474 B2 8/2013 Kang et al.
8,536,075 B2 * 9/2013 Leonard ..... D02G 3/441 442/205
10,301,751 B2 * 5/2019 Dias ..... D02G 3/22
10,480,104 B2 * 11/2019 Fu ..... D04B 1/24
10,487,423 B2 * 11/2019 Riethmüller ..... D03D 15/25
10,526,732 B2 * 1/2020 Rapp ..... D04C 3/48
10,829,870 B2 * 11/2020 Carlsson ..... D02G 3/12
11,035,058 B2 * 6/2021 Hightower, III ..... D02G 3/441
11,821,113 B2 * 11/2023 Hightower, III ..... D01H 1/115
11,891,729 B2 * 2/2024 King ..... A61B 5/266
2003/0209003 A1 * 11/2003 Verstraeten ..... D02G 3/441 57/212
2003/0211797 A1 * 11/2003 Hill ..... H05K 1/038 442/205
2004/0057176 A1 * 3/2004 Dhawan ..... H05K 3/10 361/62
2005/0282009 A1 * 12/2005 Nusko ..... D02G 3/12 264/103
2009/0139198 A1 * 6/2009 Dias ..... D02G 3/441 57/333
2013/0092742 A1 * 4/2013 Brun ..... H01L 25/50 235/492
2014/0044965 A1 * 2/2014 Linow ..... D04H 3/04 156/380.9
2016/0076178 A1 * 3/2016 Head ..... D04C 3/48 87/54
2017/0144108 A1 * 5/2017 Kim ..... H05B 3/44
2017/0275789 A1 * 9/2017 Dias ..... D02G 3/02
2018/0016718 A1 * 1/2018 Rapp ..... D04C 3/48
2018/0347081 A1 12/2018 Kurahashi et al.
2019/0201847 A1 * 7/2019 Kim ..... B01D 69/02
2020/0270775 A1 8/2020 Oppenheim

* cited by examiner

WARP KNIT AND BRAIDED FABRICS WITH ELECTRICAL COMPONENTS

This application claims the benefit of U.S. provisional patent application No. 63/507,887, filed Jun. 13, 2023, which is hereby incorporated by reference herein in its entirety.

FIELD

This relates generally to items with fabric and, more particularly, to items with fabric and electrical components.

BACKGROUND

It may be desirable to form bags, furniture, clothing, and other items from materials such as fabric. Fabric items generally do not include electrical components. It may be desirable, however, to incorporate electrical components into fabric to provide a user of a fabric item with enhanced functionality.

It can be challenging to incorporate electrical components into fabric. Fabric is flexible, so it can be difficult to mount structures to fabric. Electrical components must be coupled to signal paths (e.g., signal paths that carry data signals, power, etc.), but unless care is taken, signal paths may be damaged, or components may become dislodged as fabric is bent and stretched.

It would therefore be desirable to be able to provide improved techniques for incorporating electrical components into items with fabric.

SUMMARY

Knitting equipment and braiding equipment may be provided with individually adjustable components. The use of individually adjustable components may allow electrical components to be inserted into the fabric during the formation of the fabric.

Knitting equipment may be used to form warp knit fabric. The warp knit fabric may be a spacer fabric having a spacer strand that travels back and forth between outer warp knit layers. The spacer fabric may include a pocket for receiving an electrical component. The electrical component may be mounted to an inlaid conductive strand that floats between the outer warp knit layers and that is held in place by the space strand. The pocket may be one of multiple pockets in the spacer fabric that are separated from one another by the spacer strand. Electrical components may be mounted in the pockets.

Braiding equipment may include carriers that braid strands around an electrical component while a tool holds the electrical component in place. A ring may be used to isolate the braiding angle from the carriers to accommodate component insertion. The braiding speed may be decreased as the diameter of the braid increases to accommodate the electrical component. The electrical component may be mounted to an inlaid conductive strand in the braid.

DETAILED DESCRIPTION

Electronic devices, enclosures, and other items may be formed from fabric such as knit fabric and braided fabric. The knit or braided fabric may include strands of insulating and conductive material. Conductive strands may form signal paths through the fabric and may be coupled to electrical components such as light-emitting diodes and other light-emitting devices, integrated circuits, sensors, haptic output devices, control circuitry, and other circuitry.

Interlacing equipment (sometimes referred to as intertwining equipment) may include weaving equipment, knitting equipment, braiding equipment, or any other suitable equipment used for crossing, looping, overlapping, or otherwise coupling strands of material together to form a network of strands (e.g., fabric). Knitting equipment may be provided with individually adjustable components such as needles, needle beds, guide bars, sinkers, feeders, take-down equipment, let off equipment (e.g., devices for individually dispensing and tensioning strands), strand processing and component insertion equipment, and other components for forming fabric items. The individual adjustability of these components may allow knitting operations to be performed without requiring continuous lock-step synchronization of each of these devices, thereby allowing fabric with desired properties to be knit. As an example, normal sinker movement and other knitting operations may be periodically suspended and/or may periodically be out-of-sync with other components to accommodate component insertion operations whereby electrical components (sometimes referred to as nodes or smart nodes) are inserted into the fabric during the creation or formation of the fabric.

Braiding equipment may include carriers that braid strands around an electrical component while a tool holds the electrical component in place. A ring may be used to isolate the braiding angle from the carriers to accommodate component insertion. The braiding speed may be decreased as the diameter of the braid increases to accommodate the electrical component. The electrical component may be mounted to an inlaid conductive strand or other suitable conductive strand in the braid.

Figure 1:
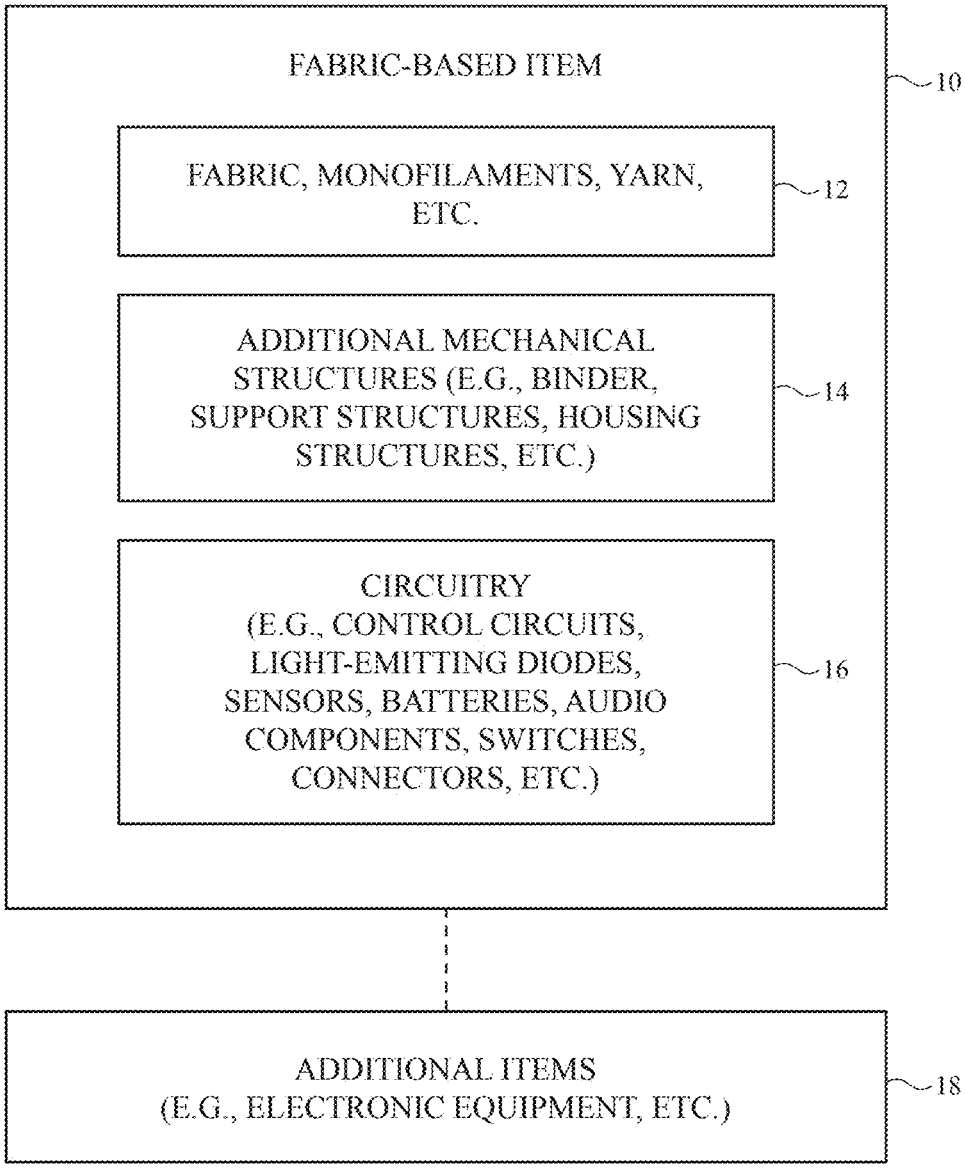
FIG. 1 is a schematic diagram of an illustrative fabric item in accordance with an embodiment.

Items such as item 10 of FIG. 1 may include fabric and may sometimes be referred to as a fabric item or fabric-based item. Item 10 may be an electronic device or an accessory for an electronic device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which fabric item 10 is mounted in a kiosk, in an automobile, airplane, or other vehicle (e.g., an autonomous or non-autonomous vehicle), other electronic equipment, or equipment that implements the functionality of two or more of these devices. If desired, item 10 may be a removable external case for electronic equipment, may be a strap, may be a wrist band or head band, may be a removable cover for a device, may be a case or bag that has straps or that has other structures to receive and carry electronic equipment and other items, may be a necklace or arm band, may be a wallet, sleeve, pocket, or other structure into which electronic equipment or other items may be inserted, may be part of a chair, sofa, or other seating (e.g., cushions or other seating structures), may be part of an item of clothing or other wearable item (e.g., a hat, belt, wrist band, headband, etc.), or may be any other suitable item that incorporates fabric.

Item 10 may include interlaced strands of material such as monofilaments and yarns that form fabric 12. As used herein, "interlaced" strands of material and "intertwined" strands of material may both refer to strands of material that are crossed with one another, looped with one another, overlapping one another, or otherwise coupled together (e.g., as part of a network of strands that make up a fabric). Fabric 12 may form all or part of a housing wall or other layer in an electronic device, may form internal structures in an electronic device, or may form other fabric-based structures. Item 10 may be soft (e.g., item 10 may have a fabric surface that yields to a light touch), may have a rigid feel (e.g., the surface of item 10 may be formed from a stiff fabric), may be coarse, may be smooth, may have ribs or other patterned textures, and/or may be formed as part of a device that has portions formed from non-fabric structures of plastic, metal, glass, crystalline materials, ceramics, or other materials.

The strands of material used in forming fabric 12 may be single-filament strands (sometimes referred to as fibers) or may be threads, yarns, or other strands that have been formed by interlacing multiple filaments of material together. Strands may be formed from polymer, metal, glass, graphite, ceramic, natural materials such as cotton or bamboo, or other organic and/or inorganic materials and combinations of these materials. Conductive coatings such as metal coatings may be formed on non-conductive strands (e.g., plastic cores) to make them conductive. Reflective coatings such as metal coatings may be applied to strands to make them reflective. Strands may also be formed from single-filament metal wire (e.g., bare metal wire), multifilament wire, or combinations of different materials. Strands may be insulating or conductive.

Strands in fabric 12 may be conductive along their entire lengths or may have conductive portions. Strands may have metal portions that are selectively exposed by locally removing insulation (e.g., to form connections with other conductive strand portions and/or to form connections with electrical components). Strands may also be formed by selectively adding a conductive layer to a portion of a non-conductive strand.). Threads and other multifilament yarns that have been formed from interlaced filaments may contain mixtures of conductive strands and insulating strands (e.g., metal strands or metal coated strands with or without exterior insulating layers may be used in combination with solid plastic strands or natural strands that are insulating). In some arrangements, which may sometimes be described herein as an example, fabric 12 may be a woven fabric and the strands that make up fabric 12 may include warp strands and weft strands.

Conductive strands and insulating strands may be woven, knit, or otherwise interlaced to form conductive paths. The conductive paths may be used in forming signal paths (e.g., signal buses, power lines for carrying power, etc.), may be used in forming part of a capacitive touch sensor electrode, a resistive touch sensor electrode, or other input-output device, or may be used in forming other patterned conductive structures. Conductive structures in fabric 12 may be used in carrying electrical current such as power, digital signals, analog signals, sensor signals, control signals, data, input signals, output signals, or other suitable electrical signals.

Item 10 may include additional mechanical structures 14 such as polymer binder to hold strands in fabric 12 together, support structures such as frame members, housing structures (e.g., an electronic device housing), and other mechanical structures.

To enhance mechanical robustness and electrical conductivity at strand-to-strand connections and/or strand-to-component connections, additional structures and materials (e.g., solder, crimped metal connections, welds, conductive adhesive such as anisotropic conductive film and other conductive adhesive, non-conductive adhesive, fasteners, etc.) may be used in fabric 12. Strand-to-strand connections may be formed where strands cross each other perpendicularly or at other strand intersections where connections are desired. Insulating material can be interposed between intersecting conductive yarns at locations in which it is not desired to form a strand-to-strand connection. The insulating material may be plastic or other dielectric, may include an insulating strand or a conductive strand with an insulating coating or insulated conductive monofilaments, etc. Solder connections may be formed between conductive strands and/or between conductive strands and electrical components by melting solder so that the solder flows over conductive strands. The solder may be melted using an inductive soldering head to heat the solder, using hot air to heat the solder, using a reflow oven to heat the solder, using a laser or hot bar to heat the solder, using localized heat from reactive films, a spark source, a laser, etc., and/or using other soldering equipment. In some arrangements, outer dielectric coating layers (e.g., outer polymer layers) may be melted away in the presence of molten solder, thereby allowing underlying metal yarns to be soldered together. In other arrangements, outer dielectric coating layers may be removed prior to soldering (e.g., using laser ablation equipment or other coating removal equipment).

Circuitry 16 may be included in item 10. Circuitry 16 may include electrical components that are coupled to fabric 12, electrical components that are housed within an enclosure formed by fabric 12, electrical components that are attached to fabric 12 using welds, solder joints, adhesive bonds (e.g., conductive adhesive bonds such as anisotropic conductive adhesive bonds or other conductive adhesive bonds), crimped connections, or other electrical and/or mechanical bonds. Circuitry 16 may include metal structures for carrying current, electrical components such as integrated circuits, light-emitting diodes, sensors, and other electrical devices. Control circuitry in circuitry 16 may be used to control the operation of item 10 and/or to support communications with item 18 and/or other devices.

Item 10 may interact with electronic equipment or other additional items 18. Items 18 may be attached to item 10 or item 10 and item 18 may be separate items that are configured to operate with each other (e.g., when one item is a case and the other is a device that fits within the case, etc.). Circuitry 16 may include antennas and other structures for supporting wireless communications with item 18. Item 18 may also interact with item 10 using a wired communications link or other connection that allows information to be exchanged.

In some situations, item 18 may be an electronic device such as a cellular telephone, computer, or other portable electronic device and item 10 may form a cover, case, bag, or other structure that receives the electronic device in a pocket, an interior cavity, or other portion of item 10. In other situations, item 18 may be a wrist-watch device or other electronic device and item 10 may be a strap or other fabric item that is attached to item 18 (e.g., item 10 and item 18 may together form a fabric-based item such as a wrist-watch with a strap). In still other situations, item 10 may be an electronic device, fabric 12 may be used in forming the electronic device, and additional items 18 may include accessories or other devices that interact with item 10. Signal paths formed from conductive yarns and monofilaments may be used to route signals in item 10 and/or item(s) 18.

The fabric that makes up item 10 may be formed from yarns and/or monofilaments that are interlaced using any suitable interlacing equipment. With one suitable arrangement, which may sometimes be described herein as an example, fabric 12 may be knit fabric formed using a knitting machine. In this type of illustrative configuration, fabric may be flat knit, weft knit, warp knit, circular knit, tricot knit, double layer knit, three-dimensional knit fabric, and/or may be other suitable fabric. This is, however, merely illustrative. If desired, fabric 12 may include woven fabric, braided fabric, other suitable type of fabric, and/or a combination of any two or more of these types of fabric.

Figure 2:
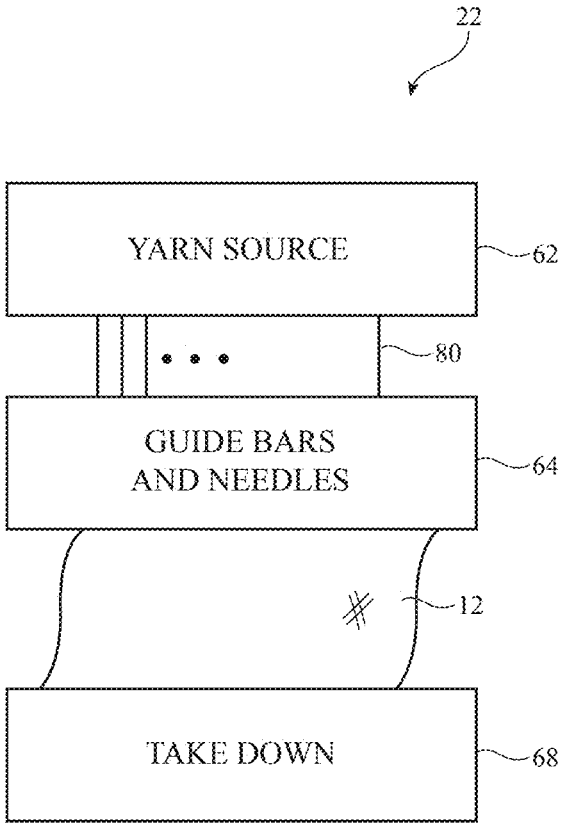
FIG. 2 is a schematic diagram of an illustrative knitting system in accordance with an embodiment.

FIG. 2 is a schematic diagram of an illustrative knitting system that may be used to form fabric 12. A warp knitting machine (e.g., a raschel warp knitting machine, a tricot warp knitting machine, a jacquard warp knitting machine, a customized warp knitting machine, and/or any other suitable warp knitting machine) or other equipment may be used in forming fabric 12 from strands 80. As shown in FIG. 2, yarn source 62 in knitting system 22 may be used in supplying strands 80 to guide and needle structures 64. Structures 64 may include strand guide structures (e.g., a system of movable guide bars with eyelets that guide strands 80) and needle systems (e.g., needle guide systems that guide sets of individually adjustable needles so that the needles may interact with the strands dispensed by the guide bars). During operations, a controller may control electrically adjustable positioners in system 22 to manipulate the positions of guide bars and needles in system 22 and thereby knit strands 80 into fabric 12. Take-down 68 (e.g., a pair of mating rollers or other equipment forming a take-down system) may be used to gather fabric 12 that is produced during knitting.

Figure 3:
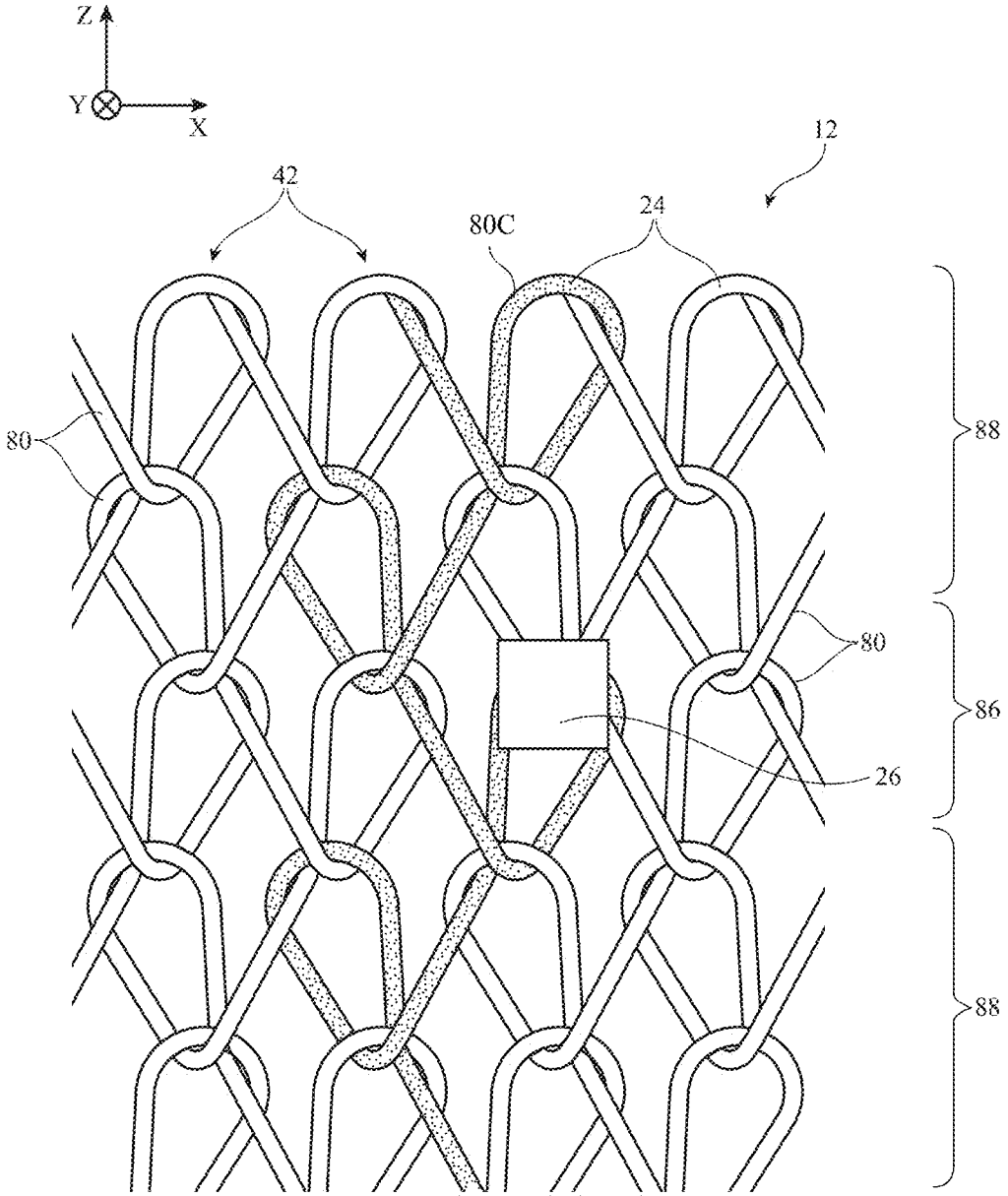
FIG. 3 is a diagram of a portion of an illustrative layer of warp knit fabric to which an electrical component has been mounted in accordance with an embodiment.

A layer of illustrative warp knit fabric 12 is shown in FIG. 3. Warp knit fabric 12 may be formed from strands 80 that form zig-zagging columns (wales) 42 of loops 24 (sometimes referred as knit stitches 24) extending down the length of the fabric. The columns 42 of loops may be interlaced with one another to form warp knit fabric 12. Strands 80 may include non-conductive strands and conductive strands such as conductive strands 80C. If desired, non-conductive strands 80 may form an outer warp knit fabric layer and conductive strand 80C may be formed only on one side of the outer warp knit fabric layer. This is merely illustrative, however. If desired, conductive strand 80C may form part of an outer warp knit fabric layer.

During knitting, control circuitry in system 22 may direct electrically adjustable positioners in system 22 to knit fabric 12 with any suitable warp knit pattern. As an example, control circuitry in system 22 may use the electrically adjustable positioners to knit conductive strands 80C in fabric 12 in preparation for receiving electrical components such as electrical component 26. Conductive strand 80C may be knitted with the rest of fabric 12 and/or may be inlaid (inserted) into fabric 12 without being knit with strands 80 that make up fabric 12.

If desired, knitting system 22 may be configured to adjust the construction of fabric 12 in a given region in preparation for receiving electrical component 26 in that region. For example, fabric 12 may have a first construction in regions 88 and a second, different construction in region 86 where electrical component 26 is mounted. For example, in regions 88, conductive strands such as conductive strand 80C may be interlaced with other strands 80 of fabric 12. In regions 86, conductive strand 80C may have one or more floats in which conductive strand 80C skips needles in regions 86 during knitting to pass over one, two, three, or more than three loops 24 of the outer warp knit fabric layer before returning to the needle bed to form stitches. Floats may also be formed by moving across needle beds (e.g., in knitting systems 22 that include first and second needle beds). Electrical component 26 may be mounted to a float formed by conductive strand 80C or may be mounted to a knit stitch 24 of conductive strand 80C. If desired, electrical component 26 may have a first terminal coupled to a first conductive strand 80C in region 86 and a second terminal coupled to a second conductive strand 80C in region 86.

Electrical component 26 may be inserted into a pocket of fabric 12 (e.g., before or after forming fabric 12), may be sandwiched between layers of knit fabric 12, may be mounted on the front or back face of fabric 12, and/or may otherwise be incorporated into fabric 12.

In some arrangements, electrical component 26 may be mounted to fabric 12 during the knitting process. For example, knitting system 22 may knit strands 80, including conductive strand 80C, electrical component 26 may be mounted to conductive strand 80C, and knitting system 22 may continue knitting strands 80 after electrical component 26 is mounted to conductive strand 80C to thereby incorporate electrical component 26 into fabric 12.

In other arrangements, electrical component 26 may be incorporated into fabric 12 after fabric 12 has been formed. For example, pockets, voids, or other component receiving areas may be created in fabric 12 and component 26 may be mounted in the component receiving areas after fabric 12 has been formed.

Processing operations such as removing insulation from conductive strands 80C, soldering electrical component 26 to conductive strands 80C, encapsulating the electrical connection between component 26 and conductive strands 80C, and/or other processing operations may take place at the time of component insertion (e.g., during fabric formation) or may be post-processing operations that take place after component 26 has been inserted and/or after fabric 12 has been formed.

Figure 4:
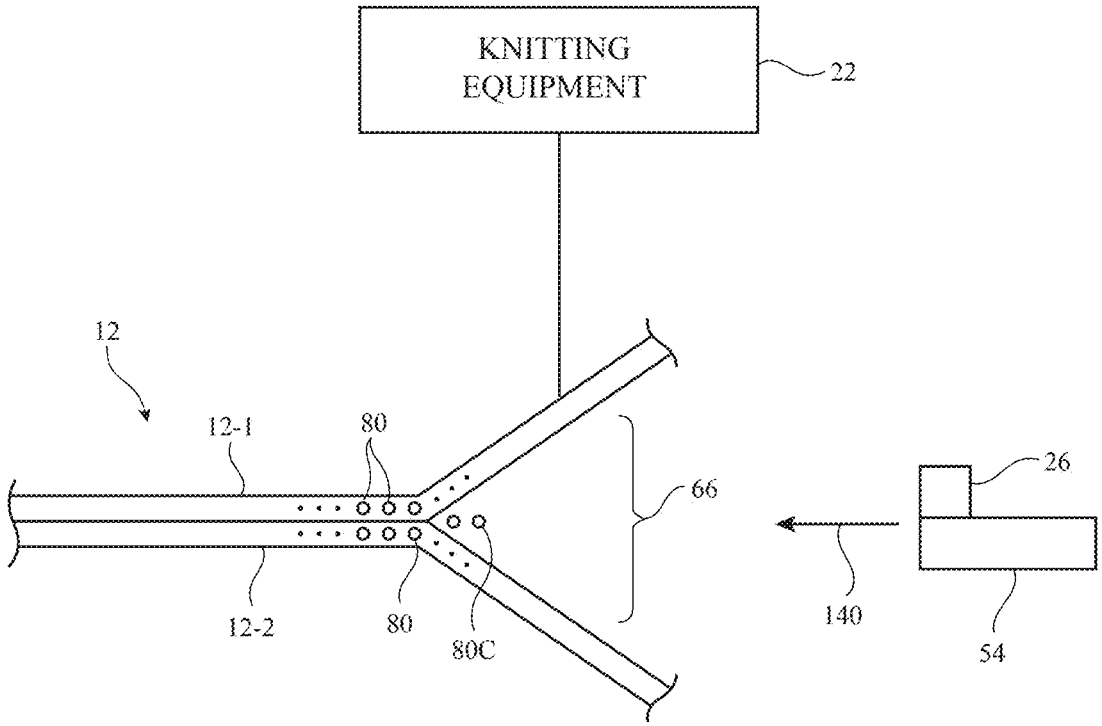
FIG. 4 is a diagram illustrating how knitting equipment may be used to create fabric while an insertion tool is used to insert electrical components into the fabric in accordance with an embodiment.

A diagram illustrating how electrical components may be inserted into fabric 12 during the formation of fabric 12 is shown in FIG. 4. As shown in FIG. 4, fabric 12 may be formed from fabric portions such as fabric portions 12-1 and 12-2. Fabric portions 12-1 and 12-2 may be formed from interlaced strands 80. For example, a first set of strands 80 may be used to form fabric portion 12-1 and a second set of strands 80 may be used to form fabric portion 12-2. Fabric portions 12-1 and 12-2 may be different portions of a single layer of fabric 12, or fabric portion 12-1 may form a first layer of fabric 12 and fabric portion 12-2 may form a second layer of fabric 12.

Using knitting equipment 22, strands 80 may be interlaced to form fabric 12. Knitting equipment 22 may include the knitting system of FIG. 2 and/or may include other interlacing equipment such as weaving equipment, braiding equipment, or other suitable interlacing equipment. Knitting equipment 22 may be used to create one or more regions in fabric 12 such as pocket 66 (sometimes referred to as a gap, space, cavity, void, position, location, etc.) for receiving electrical components such as electrical component 26. Regions in fabric 12 that receive electrical components such as pocket 66 may be formed by creating a space or gap between portions of fabric 12 such as fabric portion 12-1 and fabric portion 12-2. The term "pocket" may be used to refer to a void between fabric portions and/or may be used to refer to a position or location between fabric portions (e.g., a position between strands of material in fabric 12).

Electrical components may be inserted into pocket 66 during the formation of fabric 12 using component insertion equipment such as insertion tool 54. Insertion tool 54 may hold component 26 and may position component 26 in pocket 66 during interlacing operations (e.g., by moving component 26 towards pocket 66 in direction 140). If desired, component 26 may be electrically and mechanically connected to one or more conductive strands 80C in pocket 66. Following insertion and attachment of component 26, knitting equipment 22 may continue knitting operations (which may include closing pocket 66, if desired) to continue forming fabric 12.

In some arrangements, processing steps such as alignment of component 26 with conductive strands 80C, electrically connecting (e.g., soldering) component 26 to conductive strands 80C, encapsulation of the electrical connection between component 26 and conductive strands 80C, and/or verification of the integrity of the electrical connection between component 26 and conductive strands 80C may be performed after component 26 is inserted into pocket 66. In other arrangements, one or more of these processing steps may be performed before or at the same time component 26 is inserted into pocket 66 for easier access to component 26.

In some arrangements, the gap between first and second fabric portions 12-1 and 12-2 may remain in place after electrical component 26 is enclosed in fabric 12 (e.g., a space may exist between fabric portions 12-1 and 12-2 after formation of fabric 12 is complete). In other arrangements, first and second fabric portions 12-1 and 12-2 may be pulled together such that gap 66 is eliminated after electrical component 26 is enclosed in the gap (e.g., fabric portions 12-1 and 12-2 may be in contact with one another without an intervening gap after the formation of fabric 12 is complete). Fabric 12 may have a bulge where electrical component 26 is located, or fabric 12 may not have a bulge where electrical component 26 is located (e.g., the fabric may have substantially uniform thickness across locations with electrical components 26 and locations without electrical components 26, if desired).

Figure 5:
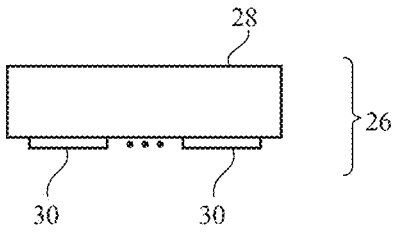
FIG. 5 is a side view of an illustrative electrical component in accordance with an embodiment.

A side view of an illustrative electrical component of the type that may be used in item 10 is shown in FIG. 5. Electrical components in item 10 such as illustrative electrical component 26 of FIG. 5 may include discrete electrical components such as resistors, capacitors, and inductors, may include connectors, may include batteries, may include input-output devices such as switches, buttons, light-emitting components such as light-emitting diodes, audio components such as microphones and speakers, vibrators (e.g., piezoelectric actuators that can vibrate), solenoids, electromechanical actuators, motors, and other electromechanical devices, microelectromechanical systems (MEMs) devices, pressure sensors, light detectors, proximity sensors (light-based proximity sensors, capacitive proximity sensors, etc.), force sensors (e.g., piezoelectric force sensors), strain gauges, moisture sensors, temperature sensors, accelerometers, gyroscopes, compasses, magnetic sensors (e.g., Hall effect sensors and magnetoresistance sensors such as giant magnetoresistance sensors), touch sensors, and other sensors, components that form displays, touch sensors arrays (e.g., arrays of capacitive touch sensor electrodes to form a touch sensor that detects touch events in two dimensions), and other input-output devices, electrical components that form control circuitry such as non-volatile and volatile memory, microprocessors, application-specific integrated circuits, system-on-chip devices, baseband processors, wired and wireless communications circuitry, and other integrated circuits.

Electrical components such as component 26 may be bare semiconductor dies (e.g., laser dies, light-emitting diode dies, integrated circuits, etc.) or packaged components (e.g. semiconductor dies or other devices packaged within plastic packages, ceramic packages, or other packaging structures). One or more electrical terminals such as contact pads 30 may be formed on body 28 of component 26. Body 28 may be a semiconductor die (e.g., a laser die, light-emitting diode die, integrated circuit, etc.) or may be a package for a component (e.g., a plastic package or other dielectric package that contains one or more semiconductor dies or other electrical devices). Contacts for body 28 such as pads 30 may be protruding leads, may be planar contacts, may be formed in an array, may be formed on any suitable surfaces of body 28, or may be any other suitable contacts for forming electrical connections to component 26. For example, pads 30 may be metal solder pads.

Figure 6:
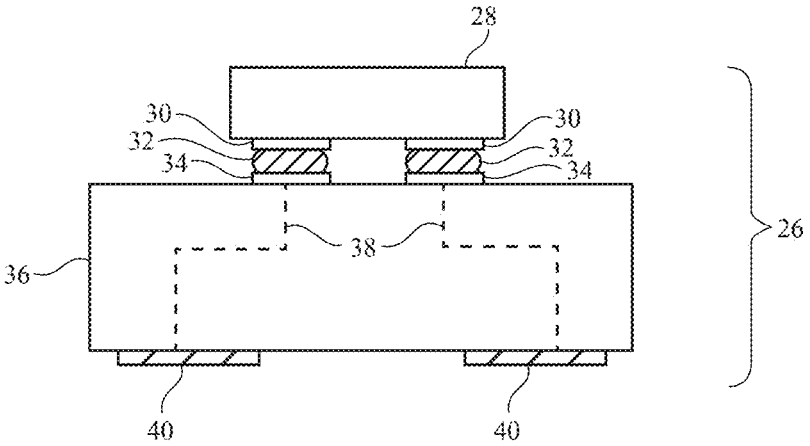
FIG. 6 is a side view of an illustrative electrical component having an electrical device mounted on an interposer in accordance with an embodiment.

As shown in the example of FIG. 6, body 28 may be mounted on a support structure such as interposer 36. Interposer 36 may be a printed circuit, ceramic carrier, or other dielectric substrate. Interposer 36 may be larger than body 28 or may have other suitable sizes. Interposer 36 may have a planar shape with a thickness of 700 microns, more than 500 microns, less than 500 microns, or other suitable thickness. The thickness of body 28 may be 500 microns, more than 300 microns, less than 1000 microns, or other suitable thickness. The footprint (area viewed from above) of body 28 and interposer 36 may be 10 microns×10 microns, 100 microns×100 microns, more than 1 mm×1 mm, less than 10 mm×10 mm, may be rectangular, may be square, may have L-shapes, or may have other suitable shapes and sizes.

Interposer 36 may contain signal paths such as metal traces 38. Metal traces 38 may have portions forming contacts such as pads 34 and 40. Pads 34 and 40 may be formed on the upper surface of interposer 36, on the lower surface of interposer 36, or on the sides of interposer 36. Conductive material such as conductive material 32 may be used in mounting body 28 to interposer 36. Conductive material 32 may be solder (e.g., low temperature or high temperature solder), may be conductive adhesive (isotropic conductive adhesive or anisotropic conductive film), may be formed during welding, or may be other conductive material for coupling electrical device pads (body pads) such as pads 30 on body 28 to interposer pads 34. Metal traces 38 in interposer 36 may couple pads 34 to other pads such as pads 40. If desired, pads 40 may be larger and/or more widely spaced than pads 34, thereby facilitating attachment of interposer 36 to conductive yarns and/or other conductive paths in item 10. Solder, conductive adhesive, or other conductive connections may be used in coupling pads 40 to conductive yarn, conductive monofilament, printed circuit traces, or other conductive path materials in item 10.

Figure 7:
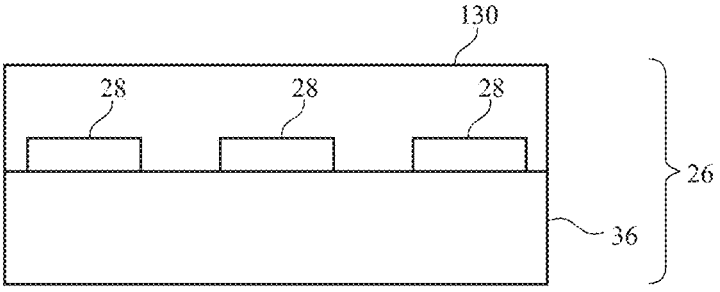
FIG. 7 is a side view of an illustrative electrical component having a protective structure in accordance with an embodiment.

FIG. 7 shows an example in which component 26 includes a protective structure such as protective structure 130 on interposer 36. Protective structure 130 may, for example, be a plastic structure that completely or partially encapsulates devices 28 and interposer 36 to provide mechanical robustness, protection from moisture and other environmental contaminants, heat sinking, and/or electrical insulation. Protective structure 130 may be formed from molded plastic (e.g., injection-molded plastic, transfer molded plastic, low-pressure molded plastic, two-part molded plastic, etc.) that has been molded over devices 28 and interposer 36 or that is pre-formed into the desired shape and subsequently attached to interposer 36, may be a layer of encapsulant material (e.g., thermoplastic) that has been melted to encapsulate devices 28, may be a layer of polymer such as polyimide that has been cut or machined into the desired shape and subsequently attached to interposer 36, or may be formed using other suitable methods. Illustrative materials that may be used to form protective structure 130 include epoxy, polyamide, polyurethane, silicone, other suitable materials, or a combination of any two or more of these materials. Protective structure 130 may be formed on one or both sides of interposer 36 (e.g., may completely or partially surround interposer 36).

Protective structure 130 may be entirely opaque, may be entirely transparent, or may have both opaque and transparent regions. Transparent portions of protective structure 130 may allow light emitted from one or more devices 28 to be transmitted through protective structure 130 and/or may allow external light to reach (and be detected by) one or more devices 28. Protective structure 130 may, if desired, have different thicknesses. The example of FIG. 7 in which protective structure 130 has uniform thickness across interposer 36 is merely illustrative. In some arrangements, protective structure 130 may be an encapsulant material such as thermoplastic that has been melted to create a robust connection between component 26 and strands 80 of fabric 12. For example, protective structure 130 may surround portions of strands 80, may fill recesses, grooves, or other features in component 26 to help interlock component 26 to strands 80, and/or may fill gaps in fabric 12.

If desired, interposer 36 may be sufficiently large to accommodate multiple electrical devices each with a respective body 28. For example, one or more light-emitting diodes, sensors, microprocessors, and/or other electrical devices may be mounted to a common interposer such as interposer 36 of FIG. 7. The light-emitting diodes may be micro-light-emitting diodes (e.g., light-emitting diode semiconductor dies having footprints of about 10 microns×10 microns, more than 5 microns×5 microns, less than 100 microns×100 microns, or other suitable sizes). The light-emitting diodes may include light-emitting diodes of different colors (e.g., red, green, blue, white, etc.), infrared light, or ultraviolet light. Redundant light-emitting diodes or other redundant circuitry may be included on interposer 36. In configurations of the type shown in FIG. 7 in which multiple electrical devices (each with a respective body 28) are mounted on a common interposer, electrical component 26 may include any suitable combination of electrical devices (e.g., light-emitting diodes, sensors, integrated circuits, actuators, and/or other devices of the type described in connection with electrical component 26 of FIG. 5).

The examples of FIGS. 6 and 7 in which devices 28 are only located on one side of interposer 36 are merely illustrative. If desired, devices 28 may be mounted to both sides of interposer 36.

Electrical components 26 may be coupled to fabric structures, individual strands, printed circuits (e.g., rigid printed circuits formed from fiberglass-filled epoxy or other rigid printed circuit board material or flexible printed circuits formed from polyimide substrate layers or other sheets of flexible polymer materials), metal or plastic parts with signal traces, or other structures in item 10.

Figure 8:
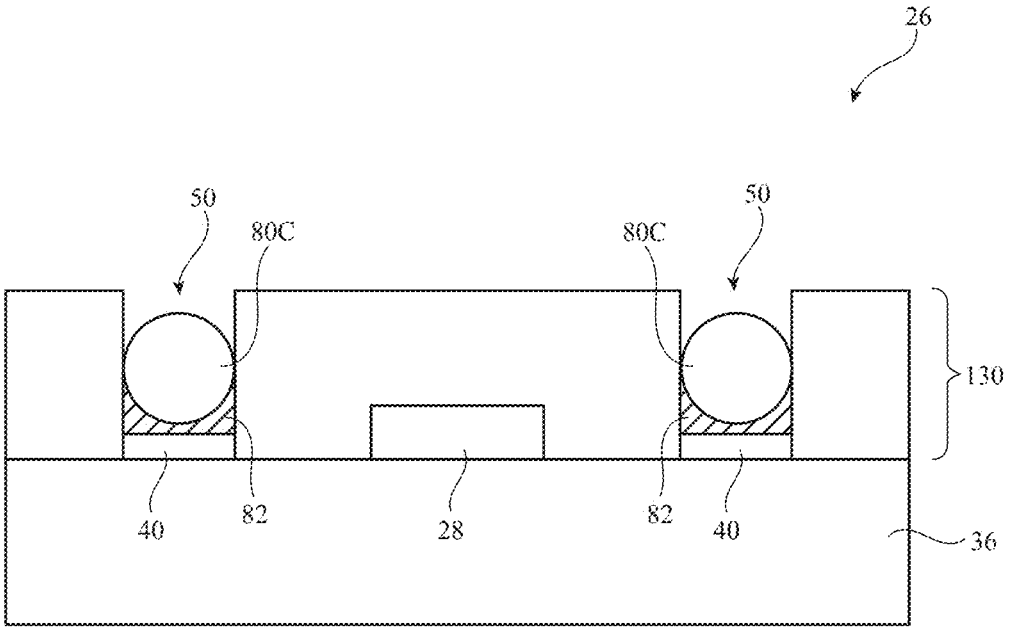
FIG. 8 is a side view of an illustrative electrical component having recesses for receiving strands in accordance with an embodiment.

In some configurations, item 10 may include electrical connections between components 26 and conductive paths in fabric 12. As shown in FIG. 8, for example, component 26 may be coupled to conductive strands 80C of fabric 12. Conductive strands 80C (sometimes referred to as "wires") may be configured to carry electrical signals (e.g., power, digital signals, analog signals, sensor signals, control signals, data, input signals, output signals, or other suitable electrical current) to and/or from components 26. Strands 80C may be weft strands, warp strands, spacer strands, and/or any other suitable strands 80 in fabric 12. If desired, component 26 may be coupled to only a single conductive strand 80C, may be coupled to two conductive strands 80C, or may be coupled to three or more conductive strands 80C. Arrangements in which component 26 is coupled to a pair of conductive strands 80C are sometimes described herein as an illustrative example.

Component 26 may have contact pads such as pad 40. Solder or other conductive material 82 may be used to couple pads 40 to conductive strands 80C. In the example of FIG. 8, pads 40 are formed on an upper surface of interposer 36 (e.g., the same surface on which device 28 is mounted). Conductive material 82 may be used to electrically and mechanically couple component 26 to strands 80C of fabric 12. If desired, pads 40 may instead or may be additionally formed on the lower surface of interposer 36 (e.g., the surface opposite the surface on which device 28 is mounted). The example of FIG. 8 is merely illustrative.

In some configurations, it may be desirable to provide a more robust mechanical connection between component 26 (e.g., component 26 of FIG. 5, 6, 7, or 8) and fabric 12 to ensure that component 26 does not come loose when fabric 12 is bent or stretched. To increase the robustness of the connection between strands 80C and component 26, component 26 may have one or more recesses for receiving strands 80C. For example, strands 80C may each be threaded through a portion of component 26 to help secure component 26 to fabric 12. Strands 80 may be threaded through recesses, openings, trenches, grooves, holes, and/or other engagement features of component 26. The recesses, openings, trenches, grooves, holes, or other engagement features may be formed in device 28, interposer 36, protective structure 130, and/or other portions of component 26. FIG. 8 shows an example in which conductive strands 80C are received within grooves such as grooves 50 that are formed in protective structure 130. This is, however, merely illustrative. If desired, grooves 50 may instead or additionally be formed in interposer 36, device 28, and/or other portions of component 26. The location, shape, and geometry of grooves 50 of FIG. 8 are merely illustrative.

Grooves 50 (sometimes referred to as trenches, openings, notches, recesses, holes, through-holes, etc.) in protective structure 130 may be formed by removing portions of protective structure 130 (e.g., using a laser, a mechanical saw, a mechanical mill, or other equipment) or may be formed by molding (e.g., injection molding) or otherwise forming protective structure 130 into a shape that includes grooves 50. Grooves 50 may have a width between 2 mm and 6 mm, between 0.3 mm and 1.5 mm, between 1 mm and 5 mm, between 3 mm and 8 mm, greater than 3 mm, less than 3 mm, or other suitable width. If desired, trenches 50 may have different depths (e.g., to expose contact pads 40 that are located at different surface heights of interposer 36).

Grooves 50 may expose conductive pads 40 on interposer 36. Strands 80C may each be threaded through an associated one of grooves 50 in protective structure 130. Solder or other conductive material 82 may be used to electrically and mechanically couple strands 80C to conductive pads 40 in grooves 50 of protective cover 130. Because strands 80C are wedged between portions of protective cover 130, strands 80C may be resistant to becoming dislodged from interposer 36. In addition to holding strands 80C in place so that component 26 remains attached to fabric 12, grooves 50 may also be used as a physical guide for aligning component 26 relative to fabric 12 during component insertion and attachment operations. This may be beneficial when inserting and attaching component 26 to fabric 12 without line of sight.

Each strand 80C may align with an associated pad 40 on component 26. If desired, pads 40 may formed from elongated strips of conductive material (e.g., metal) that extend from one edge of interposer 36 to an opposing edge of interposer 36. This provides a large area with which to form a mechanical and electrical connection between interposer 36 and strands 80C. The elongated shape of pads 40 may allow conductive material 82 to attach a longer portion of strand 80C to pad 40. The connection between pad 40 and strand 80C may, for example, span across the width of interposer 36, thereby providing a robust connection between interposer 36 and strand 80C. This is, however, merely illustrative. If desired, pads 40, conductive material 82, and the exposed conductive portions of strands 80C may span across less than all of the width of component 26.

Figure 9:
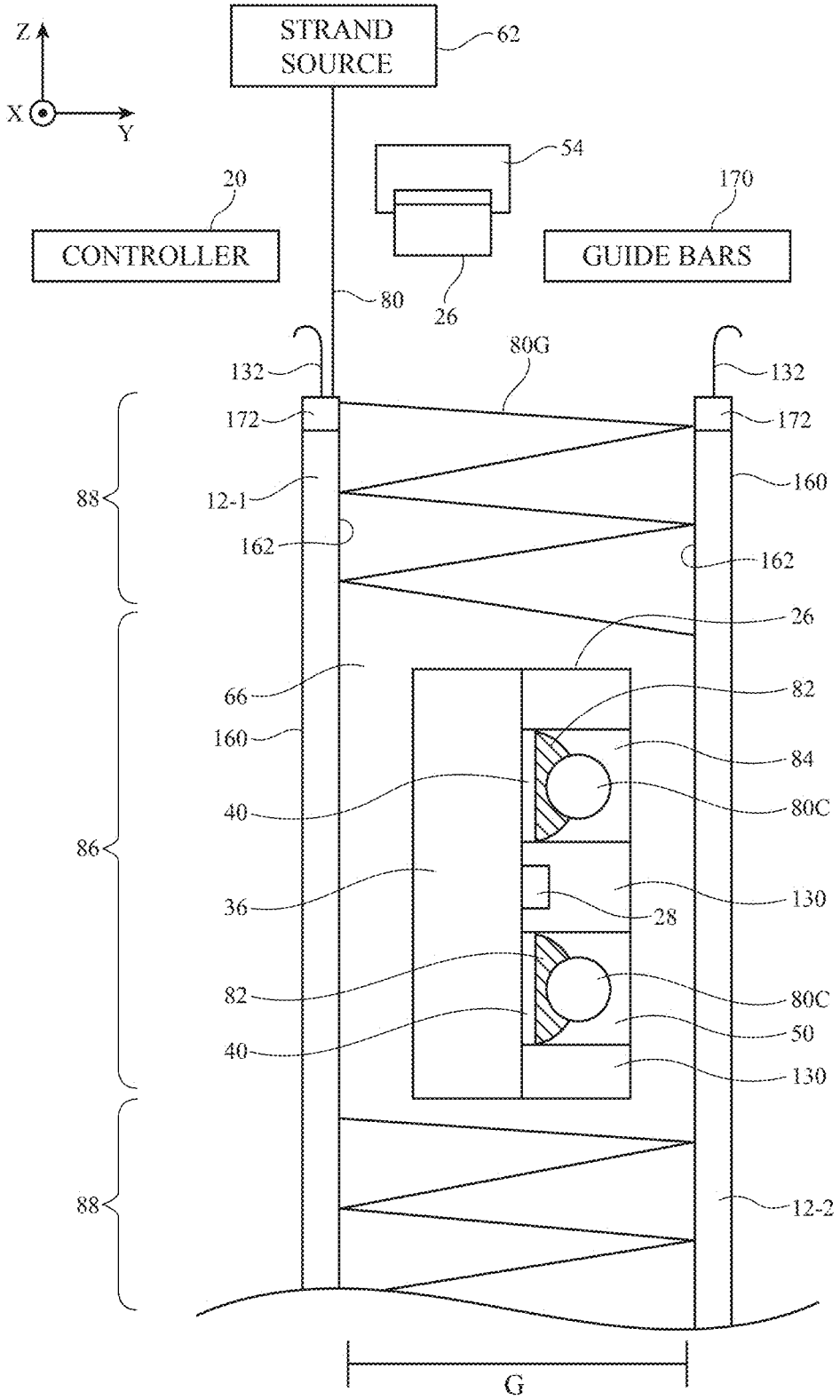
FIG. 9 is a side view of illustrative knitting equipment being used to form a spacer knit fabric with an electrical component interposed between first and second outer warp knit layers in accordance with an embodiment.

FIG. 9 is a side view of an illustrative warp knit fabric 12 with embedded components. In the example of FIG. 9, fabric 12 is a spacer warp knit fabric having first and second outer fabric layers 12-1 and 12-2. Outer fabric layers 12-1 and 12-2 may be warp knit fabric layers of the type shown in FIG. 3. Spacer fabrics of the type shown in FIG. 9 may be formed using first and second needle beds in knitting system 22. For example, a first bed of needles 132 may be used to knit fabric layer 12-1 and a second bed of needles 132 may be used to knit fabric layer 12-2. The row of needles 132 that forms each bed may extend parallel to X-axis of FIG. 9. If desired, fabric 12 may include more than two layers of warp knit fabric and/or may be formed using more than two needle beds. The arrangement of FIG. 9 is merely illustrative.

Controller 20 may control the operation of equipment 22. Controller 20 (sometimes referred to as control circuitry 20) may include storage and processing circuitry for implementing control functions during knitting operations. The storage may include, for example, random-access memory, non-volatile memory such as read-only memory, hard disk storage, etc. The processing circuitry may include microprocessors, microcontrollers, digital signal processors, application-specific integrated circuits, and other circuits for executing software instructions obtained from storage.

In knitting arrangements, knitting equipment 22 includes a strand source such as strand source 62. Source 62 may supply strands 80 from a beam, a creel, cones, bobbin, or other strand dispensing structure. Source 62 may, for example, dispense strands 80 through electrically controlled dispensing rollers or other strand dispensing and tensioning equipment (e.g., a rotating drum, electrically controlled actuators, sensors, and/or other equipment that measures, controls, and/or adjusts strand feed and tension of strands 80).

Needles 132 may have first and second support structures (first and second needle guide systems) for respectively supporting first and second sets of needles 132. These support structures, which may sometimes be referred to as needle beds, needle guide structures, needle guides, or needle systems, may have conical shapes or may have other suitable shapes, (e.g., cylindrical shapes, cylindrical shapes with planar inserted sections, etc.). System 22 may support any suitable numbers of needles 132 (e.g., tens of needles, hundreds of needles, or more). As an example, each needle bed may support 100-400 needles 132, at least 50 needles 132, at least 200 needles 132, fewer than 500 needles 132, etc.

Guide bar system 170, which may sometimes be referred to as guide bars, a strand guide system, yarn guide system, guide bar system, or strand guiding system, may include a series of guide bars that are used in providing needles 132 with strands 80. Needles 132 may be moved using electrically adjustable positioners 172. Guide bars 170 may be positioned using adjustable guide bar positioners. The separation (gap G) between the first and second beds of needles 132 can be adjusted by moving the support structures that support needles 132 (e.g., in response to control signals from controller 20).

Strand dispensing equipment 62, needles 132, guide bars 170, and/or other equipment in system 22 such as sinkers, take-down equipment, etc., may be independently controlled by controller 20. At the same time, and in coordination with the control of these components, controller 20 may control component insertion and strand processing equipment in equipment 22 (e.g., so that light-emitting diodes, integrated circuits, sensors, and other electrical components such as component 26 can be inserted into fabric 12).

For example, controller 20 may temporarily suspend or slow knitting operations (e.g., may temporarily suspend or slow movement of knitting components such as strand source 62, guide bars 170, needles 132, and/or other equipment in system 22) while electrically controlled strand processing equipment performs processing operations on strands 80, while component insertion tool 54 inserts electrical components into fabric 12, and/or while soldering operations take place (e.g., during which contacts 40 on electrical components 26 are soldered to conductive strands 80C).

System 22 may include insulation removal tools such as lasers, heating elements, and/or other components that generate light, heat, and/or other energy for removing insulation from the exterior of insulated conductive strands 80C. Heating tools in system 22 may include an inductive head, heating elements, a hot air source, lasers, a localized heat source, and/or other components that generate heat and/or other energy for melting solder and/or melting encapsulant material on components 26. For example, solder 82 may be reflowed on contacts 40 to thereby solder component 26 to conductive strands 80C. Encapsulant material such as portions of protective structure 130 may also be melted using a heating tool to form a robust mechanical connection and provide encapsulation around the electrical connection. If desired, equipment 22 may include other strand processing equipment such as components for applying coatings and/or other equipment for modifying strands 80.

In the example of FIG. 9, encapsulant material 84 (e.g., thermoplastic, epoxy, polyamide, polyurethane, silicone, other suitable materials, or a combination of any two or more of these materials) may encapsulate the solder connection between component 26 and conductive strands 80C. Encapsulant material 84 may be a part of protective structure 130 that is melted to cover the solder connection in each groove 50, or encapsulant material 84 may be a separate encapsulant material that is dispensed in each groove 50. In some arrangements, encapsulant material 84 may be formed from a dual-phase solder material (e.g., a solder material that releases encapsulation material during the soldering process). If desired, component 26 may include both encapsulant that is dispensed in grooves 50 (e.g., on an upper and/or lower side of component 26) as well as thermoplastic that is melted (e.g., on an upper and/or lower side of component 26) to help secure component 26 to fabric 12.

If desired, insulation may be removed from strands, solder may be reflowed, and encapsulant material may be melted using a single tool (e.g., a laser and/or heating element may be used to remove insulation, reflow solder, and melt encapsulant material at the same time and/or at different times). Arrangements where a first tool (e.g., a laser) is used to remove insulation from strands 80 and a second tool (e.g., an inductive heating tool, hot air, laser, etc.) is used to reflow solder and melt encapsulant material are sometimes described herein as an illustrative example. If desired, one or more sensors such as a pyrometer may be used to monitor the temperature of component 26, fabric 12, and/or other components during insulation removal operations, during solder reflow operations, and/or during the melting of encapsulant material. If desired, conductive strands in fabric 12 such as conductive strands 80C may include non-insulated conductive strands (e.g., strands that do not include an outer insulator) and an insulation removal tool may not be needed.

Component insertion equipment for inserting components into fabric 12 during the formation of fabric 12 may include insertion tool 54. Insertion tool 54 may include an insertion head and an electrically controlled positioner that positions the insertion head within pocket 66. Insertion tool 54 may be used to insert components 26 (e.g., electrical components) into fabric 12. For example, insertion tool 54 may place component 26 in pocket 66 and may align grooves 50 in component 26 with conductive strands 80C. The exposed conductive segments of conductive strands 80C in pocket 66 are received within grooves 50 and aligned with pads 40 of component 26. In other arrangements, insertion tool 54 may align component 26 with segments of strands 80C that are initially located outside of pocket 66. In this type of scenario, component 26 may be aligned with strands 80C, electrically connected (e.g., soldered) to strands 80C, and encapsulated (if desired) before component 26 is inserted into pocket 66. If desired, equipment 22 may include a spreading tool for spreading strands 80 to create an opening in fabric 12 through which component 26 may be accessed for out-of-pocket processing of component 26.

If desired, fabric 12 may have multiple pockets 66 for multiple components 26 and/or may have multiple components 26 in each pocket 66. If desired, components 26 may be mounted to portions of fabric 12 other than pockets 66 during the formation of fabric 12 (e.g., may be mounted to an upper or lower surface of fabric 12 and/or to other portions of fabric 12). Pockets 66 may be staggered with respect to one another or formed in one line. Multiple components 26 in one pocket 66 may be staggered with respect to one another or formed in one line. If desired, multiple components 26 may be electrically connected to the same pair of conductive strands and/or a component may have a first terminal coupled to one portion of a strand and a second terminal coupled to a second portion of the same strand. Pocket 66 may be entirely opaque, may be entirely transparent, or may have both opaque and transparent regions. Transparent portions of pocket 66 may allow light emitted from one or more devices 28 to be transmitted through fabric 12 and/or may allow external light to reach (and be detected by) one or more devices 28.

Insertion tool 54 may include one or more components for mounting electrical components 26 in fabric 12. For example, insertion tool 54 may include an electrically controlled actuator for regulating the release of components 26 from insertion tool 54 (e.g., when component 26 is in pocket 66), may include sensors for monitoring the positions of strands 80, sensors for monitoring the positions of components 26, sensors for measuring temperature, sensors for measuring resistance, or other devices for gathering input and/or data on the environment surrounding insertion tool 54.

If desired, needles may transfer strands 80 and/or loops of strands 80 from one needle bed to the opposing needle bed to form a connecting layer between fabric layers 12-1 and 12-2. As shown in FIG. 9, for example, fabric 12 may include spacer strands 80G that join outer fabric layers 12-1 and 12-2 to form spacer fabric 12. Strands 80G may be insulating (e.g., non-conductive) strands or may be conductive strands (e.g., conductive strands 80C may also from connecting strands 80G connecting layers 12-1 and 12-2, if desired). Spacer strand 80G may be a monofilament or multifilament strand.

Controller 20 may adjust the operation of one or more components of system 22 in preparation for incorporating electrical component 26 in fabric 12. For example, controller 20 may adjust knitting equipment 22 to form regions 88 and regions 86. In regions 88, spacer strand 80G travels back and forth between fabric portions 12-1 and 12-2 to form a spacer layer between outer layers 12-1 and 12-2. In component receiving region 86, pocket 66 may be created by suspending or slowing movement of one or more guide bars 170. For example, in regions 88, a guide bar 170 may be used to move spacer strands 80G back and forth between the two needle beds. In region 86, the guide bar 70 may be deactivated (or moved at a slower speed) to create a void such as pocket 66 where spacer strands 80G do not travel back and forth between outer fabric layers 12-1 and 12-2 in region 86. When pocket 66 is formed, insertion tool 54 may insert component 26 into pocket 66 and guide bars 170 may continue guiding spacer strand 80G back and forth between fabric layers 12-1 and 12-2 to close pocket 66 and thereby enclose component 26 within pocket 66. As shown in FIG. 9, spacer strand 80G may be formed on opposing sides of pocket 66 or may otherwise surround pocket 66. If desired, sinkers in system 22 (e.g., sinkers that would normally be used to push loops down after the loops are formed with needles 132) may be removed or temporarily deactivated in region 86 to avoid damaging component 26 or dislodging component 26 from fabric 12.

Component 26 may, for example, be mounted to floats of conductive strand 80C that are floating within pocket 66 relative to one or both of outer fabric layers 12-1 and 12-2. For example, conductive strands 80C may be inlaid or inserted strands that float between outer warp knit layers 12-1 and 12-2. Inlaid strands such as a floating conductive strand 80C may be held in place by spacer strand 80G and may run in the wale direction (e.g., parallel to the Z-axis of FIG. 9) or in the course direction (e.g., parallel to the X-axis of FIG. 9).

Component 26 may be mounted to outer exposed surfaces 160 of outer fabric layers 12-1 and 12-2, may be mounted to inner hidden surfaces 162 of outer fabric layers 12-1 and 12-2, may be mounted to spacer strands 80G that connect outer layers 12-1 and 12-2 (e.g., spacer strands 80G that maintain gap G between outer warp knit layers 12-1 and 12-2), may be mounted to inlaid or inserted strands 80C that float relative to outer warp knit layers 12-1 and 12-2 and that are held in place by spacer strand 80G, and/or may be mounted to other strands 80C. in fabric 12 (e.g., braided strands, woven strands, etc.).

In the example of FIG. 9, conductive strands 80C are floating with respect to one or both of outer warp knit layers 12-1 and 12-2 and are held in place by spacer strands 80G. Strands 80C may be received within grooves 50 of component 26 and soldered to bond pads 40 in grooves 50 using solder 82.

Soldering operations may take place before, during, or after component 26 is inserted within pocket 66 and/or after fabric 12 is formed. If desired, a localized heating tool that creates localized heat such as a spark (e.g., using reactive films and/or other localized heating techniques) may be used to reflow solder 82 without overheating component 26 and/or fabric 12.

Figure 10:
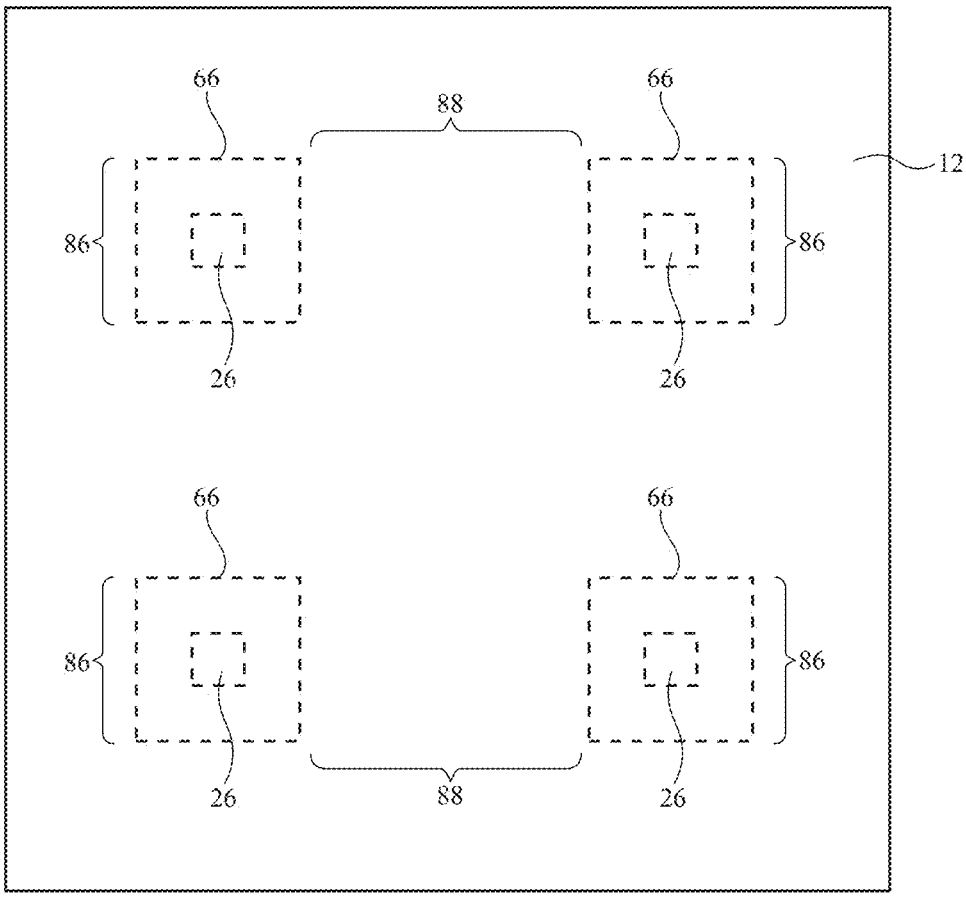
FIG. 10 is a front view of an illustrative warp knit fabric having multiple pockets and electrical components in accordance with an embodiment.

FIG. 10 is a front view of an illustrative fabric 12 that incorporates multiple pockets and multiple electrical components. Fabric 12 may be a warp knit fabric (e.g., a spacer warp knit fabric and/or any other suitable type of warp knit fabric) having pockets such as pockets 66. There may be one, two, three, four, ten, more than ten, or less than ten pockets 66 in fabric 12. Pockets 66 may be formed in component receiving regions 86 of fabric 12. Component receiving regions 86 may be separated from one another by regions 88. In regions 88, outer fabric layers 12-1 and 12-2 are connected using spacer strand 80G and/or using other suitable strands. In regions 86, spacer strand 80G may not be present or may have a lower gauge than in regions 88. This provides additional space such as space 66 for receiving electrical components 26.

Conductive strands 80C may be incorporated into regions 86 and may pass through pockets 66. Each electrical component 26 in pockets 66 may be coupled to one or more conductive strands 80C. Electrical components 26 may be inserted into pockets 66 during knitting (as described in connection with FIGS. 4 and 9), and/or electrical components 26 may be inserted into pockets 66 after fabric 12 is formed.

Figure 11:
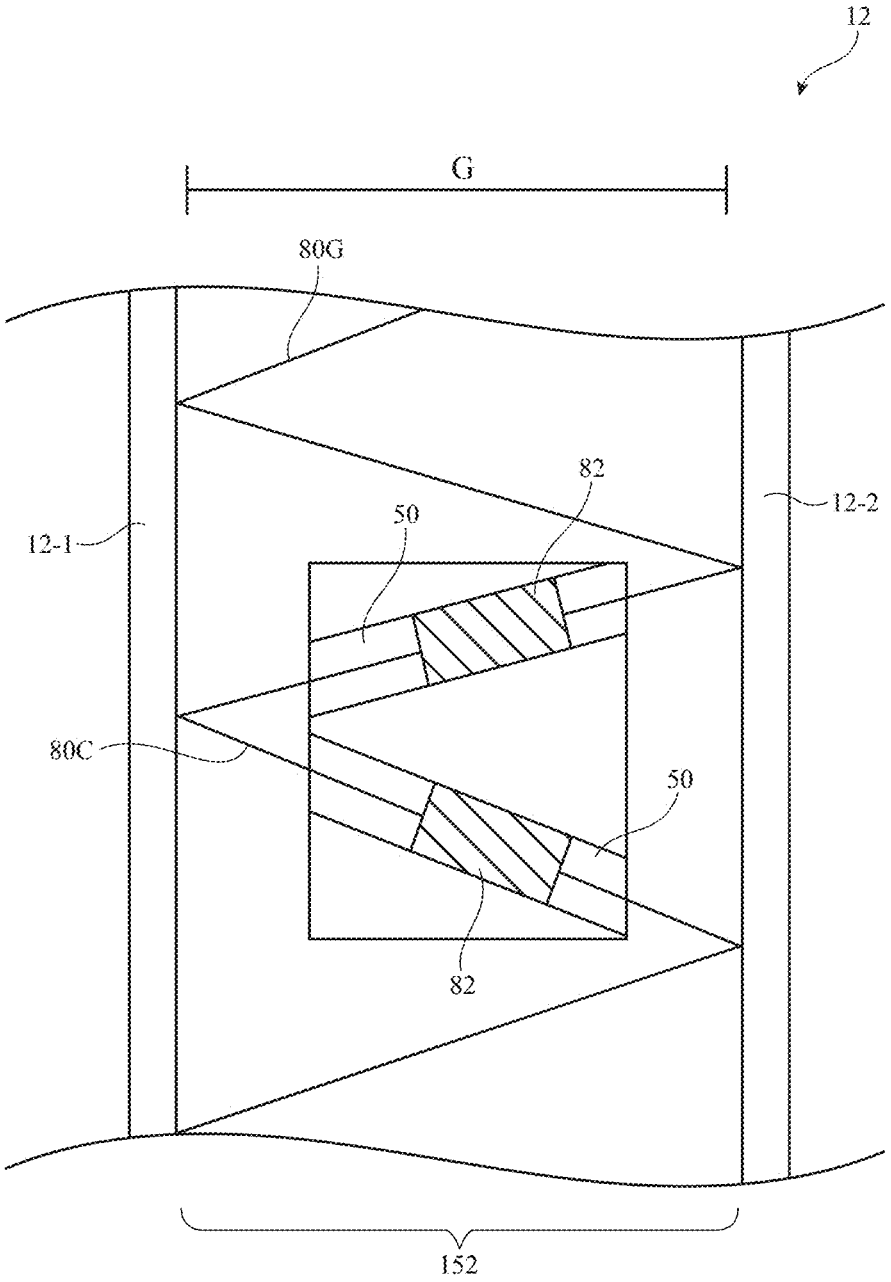
FIG. 11 is a side view of an illustrative spacer fabric having an electrical component with angled grooves for receiving a spacer strand in accordance with an embodiment.

FIG. 11 is a top view of fabric 12 showing how spacer strands 80G may form a spacer layer 152 between outer fabric layers 12-1 and 12-2. Spacer strand 80G may be formed from conductive strand 80C. Spacer layer 152 may be formed entirely from conductive strands 80C or may only be formed from conductive strands 80C in regions 86 where component 26 is received.

If desired, grooves on component 26 may be shaped to receive spacer strands 80C in spacer layer 152. As shown in FIG. 11, for example, grooves 50 may be non-parallel grooves that are angled at non-zero angles with respect to one another. Grooves 50 may be plated through-holes and/or may have other conductive materials for electrically coupling component 26 to strands 80C using solder 82. The angle of grooves 50 may help accommodate the natural shape of spacer strands 80G within fabric 12.

Figure 12:
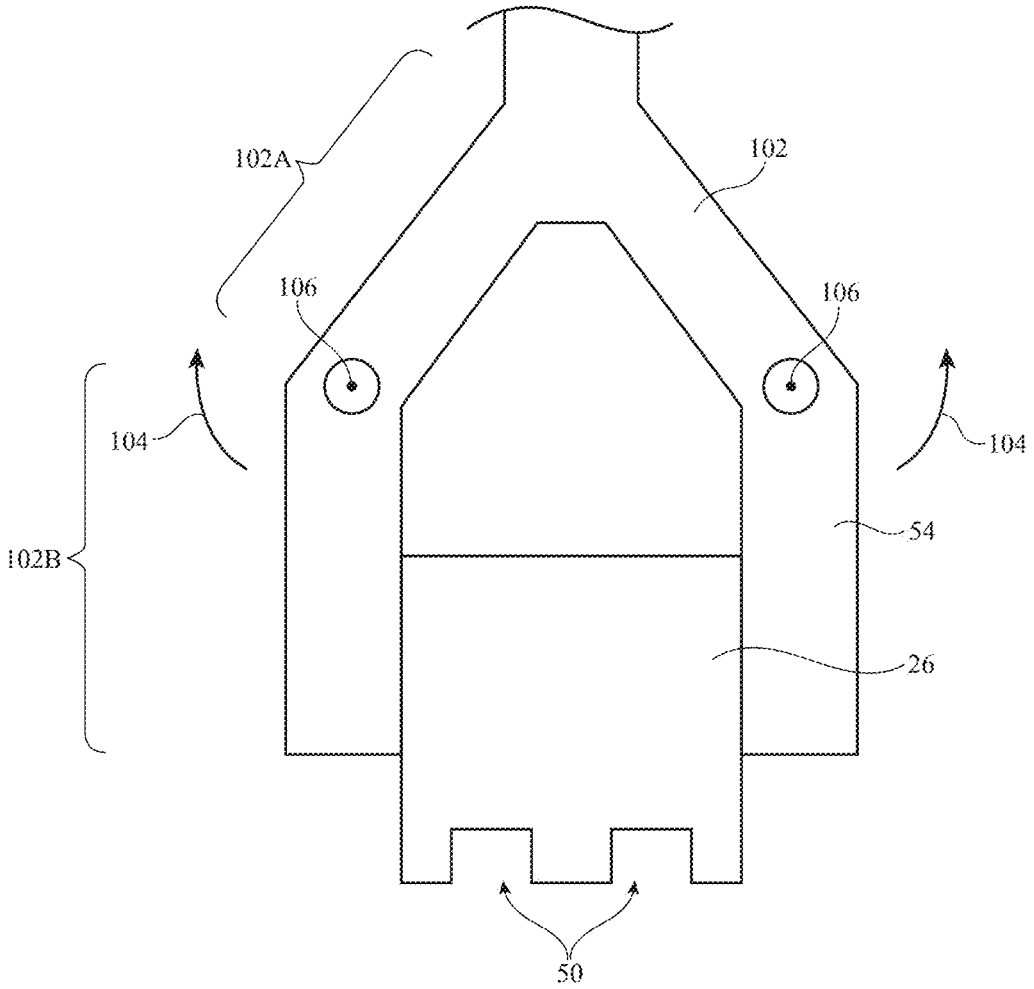
FIG. 12 is a side view of an illustrative insertion tool gripping an electrical component in accordance with an embodiment.

FIG. 12 is a front view of an illustrative insertion tool that may be used to insert electrical components 26 into fabric 12 during knitting. As shown in FIG. 12, insertion tool 54 may be a gripper having first and second arms 102 that grip the sides of electrical component 50. The gripper shape of tool 54 may facilitate insertion operations by allowing tool 54 to be inserted from the top of fabric 12 (e.g., parallel to the Z-axis of FIG. 9 between needles 132) or from the side of fabric 12 (e.g., parallel to the X-axis of FIG. 9 between outer fabric layers 12-1 and 12-2).

If desired, arms 102 may include one or more movable portions that move to grip and release component 26. As shown in FIG. 12, for example, arms 102 may include first and second arm members 102A and 102B that are configured to rotate relative to one another about rotational axis 106. When it is desired to release component 26 from tool 54 (e.g., to insert component 26 in pocket 66), arm members 102B may rotate relative to arm members 102A about axes 106 outwardly in directions 104. This is merely illustrative. If desired, other mechanisms such as retracting members, sliding members, and/or other release mechanisms may be used in tool 54 to allow tool 54 to release component 26 into pocket 66.

Figure 13:
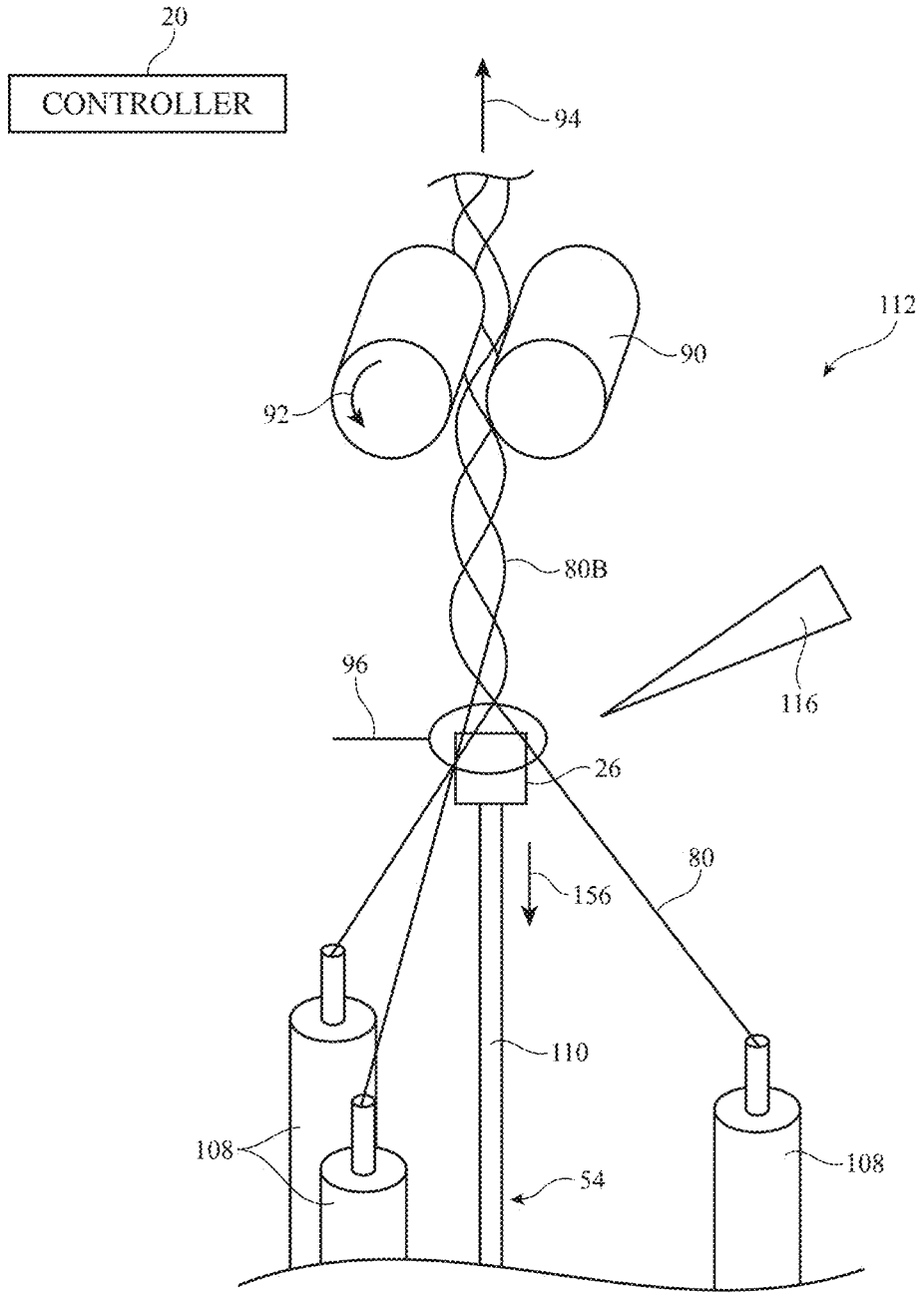
FIG. 13 is a perspective view of illustrative braiding equipment being used to braid strands around an electrical component in accordance with an embodiment.

FIG. 13 is a perspective view of illustrative braiding equipment being used to form fabric 12 with embedded components.

As shown in FIG. 13, braiding equipment 112 may include carriers 108. Carriers 108 may be mounted to rotating horn gears or other rotating members and may include bobbins for dispensing strands 80. As the horn gears rotate, carriers 108 may be transferred between the horn gears and the bobbins may pass over and under one another in an alternating fashion (e.g., each carrier 108 may follow a pseudo-sinusoidal path or figure eight path) to create a braid such as braid 80B. Braid 80B may be taken up by rollers 90 that rotate in direction 92 to guide braid 80B upwards in direction 94. A braiding hoop or other ring 96 may be used to adjust the braiding angle.

If desired, conductive strands may be incorporated into braid 80B. Conductive strands 80C may be braided strands that are braided to form braid 80B, may be core strands at the core of a braided strand such as braid 80B, may be covering strands that wrap around a core, or may be inlaid strands that extend along the longitudinal axis of braid 80B without being braided.

Components in braiding machine 112 such as carriers 108, ring 96, rollers 90, and/or other braiding machine components may be independently controlled by controller 20. Controller 20 may also control component insertion and strand processing equipment in equipment 112 (e.g., so that light-emitting diodes, integrated circuits, sensors, and other electrical components such as component 26 can be inserted into fabric 12).

For example, controller 20 may temporarily suspend or slow braiding operations (e.g., may temporarily suspend or slow movement of braiding components such as carriers 108, rollers 90, etc.) while electrically controlled strand processing equipment performs processing operations on strands 80, while component insertion tool 54 inserts electrical components 26 into fabric 12, and/or while soldering operations with soldering tool 116 take place (e.g., during which contacts 40 on electrical component 26 are soldered to conductive strands 80C).

Soldering operations may take place before, during, or after component 26 is inserted into braid 80B and/or after braid 80B is formed. As shown in FIG. 13, heating tool 116 may be used to generate heat and/or other energy for melting solder and/or melting encapsulant material on components 26 to thereby electrically and mechanically couple component 26 to conductive strands 80C within braid 80B. Heating tools in system 112 such as heating tool 116 may include an inductive head, heating elements, a hot air source, lasers, a localized heat source, and/or other components that generate heat and/or other energy for melting solder and/or melting encapsulant material on components 26. If desired, tool 116 may be a localized heating tool that creates localized heat such as a spark (e.g., using reactive films and/or other localized heating techniques) to reflow solder on component 26 without overheating component 26 and/or braid 80B.

Insertion tool 54 may include a shaft such as shaft 110. Shaft 110 may be configured to hold component 26 in place within braid 80B as strands 80 are braided around component 26. In particular, as strands 80 are braided around component 26, the tension of strands 80 may apply a downward force on component 26 in direction 156. Shaft 110 may be configured to counteract the downward force on component 26 by applying a force on component 26 in direction 94.

As the braid encloses component 26, the downward force on component 26 may decrease and an upward force applied by strands 80 on component 26 in direction 94 may increase (e.g., as the braid reaches the bottom of component 26). If desired, shaft 110 may have a second portion located above component 26 (or shaft 110 may be moved to a location above component 26) to counteract upward forces on component 26 by applying a downward force on component 26 in direction 156.

Controller 20 may be configured to control the speed at which braiding occurs to accommodate component 26. For example, as braided strand 80B increases in diameter to wrap around component 26, controller 20 may reduce the braiding speed (e.g., the speed at which carriers 108 are moved) so that strands 80 have more time to fully surround and enclose component 26. As the diameter of braided strand 80B decreases again (e.g., after passing most of component 26), controller 20 may increase the speed of braiding to a normal speed.

Figure 14:
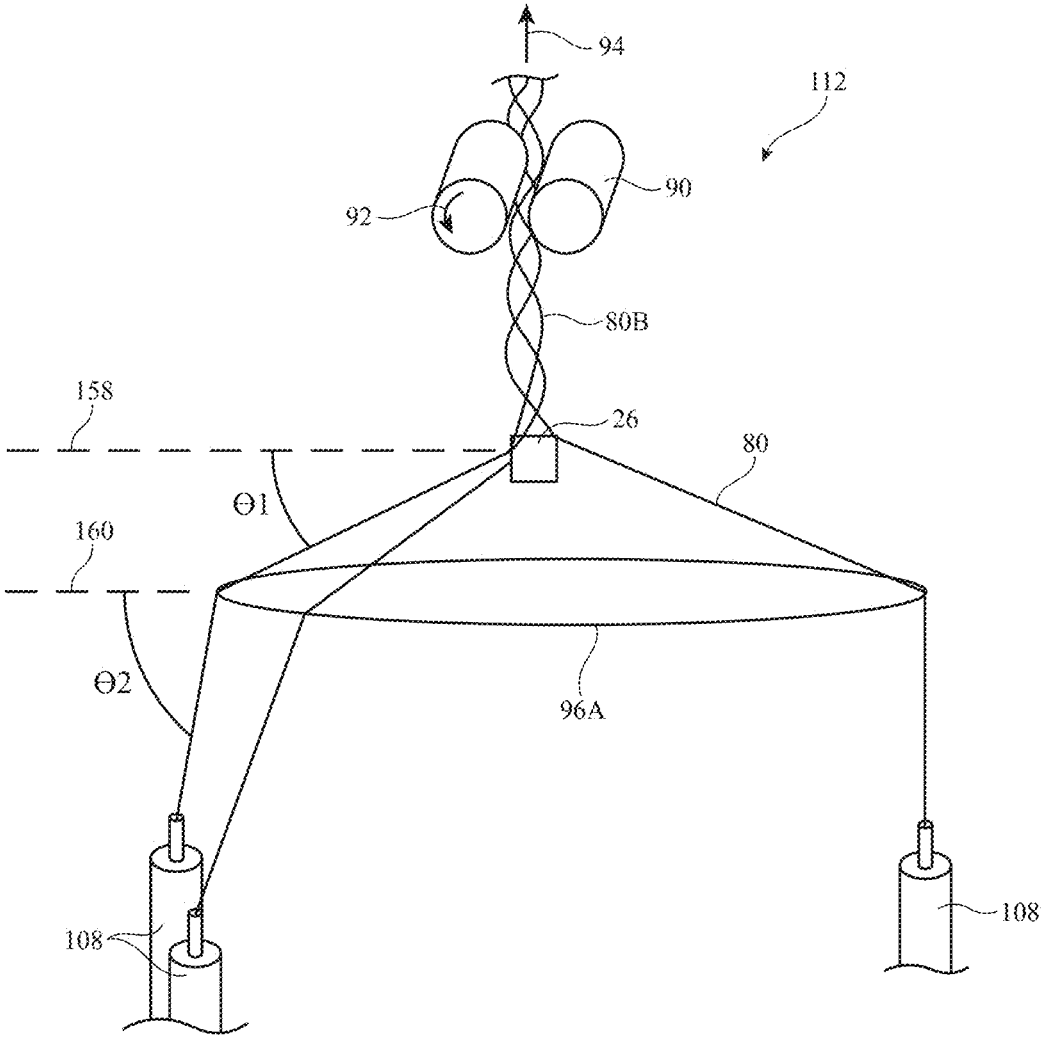
FIG. 14 is a perspective view of illustrative braiding equipment in which a ring is used to isolate a braiding angle while an electrical component is inserted into the braid in accordance with an embodiment.

Braiding ring 96 may have an adjustable diameter and/or an adjustable height to adjust the braiding angle during braiding. If desired, braiding ring 96 may be configured to isolate the braiding angle from carriers 108 during component insertion operations so that braided strands do not interfere with component insertion and do not interfere with motion of carriers 108. As shown in FIG. 14, for example, ring 96A may be used to isolate braiding angle θ1 from carrier angle θ2. In particular, ring 96A may be used to hold a first portion of strands 80 at a first angle θ1 relative to electrical component 26 and to hold a second portion of strands 80 at a second angle relative to carriers 108.

Above ring 96A, strands 80 may be located at angle θ1 relative to horizontal axis 158. Angle θ1 may be less than 45 degrees, less than 30 degrees, less than 15 degrees, more than 15 degrees, or any other suitable angle. Below ring 96A, strands 80 may be located at angle θ2 relative to horizontal axis 160. Angle θ2 may be 45 degrees, greater than 45 degrees, greater than 60 degrees, less than 60 degrees, and/or any other suitable angle. The smaller angle above ring 96A provides additional space for component 26 to be inserted within braid 80B as strands 80 are braided around component 26, while the larger angle below ring 96A provides sufficient room for carriers 108 to operate normally without interfering with strands 80 as strands 80 are braided around component 26.

Figure 15:
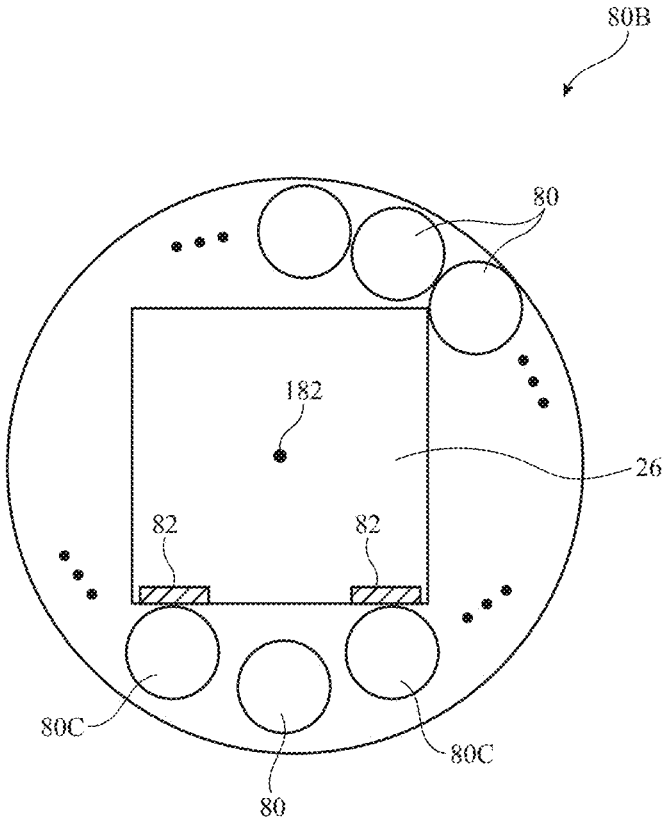
FIG. 15 is a cross-sectional side view of an illustrative braided strand having an electrical component mounted to an inlaid conductive strand in accordance with an embodiment.

FIG. 15 is a cross-sectional side view of an illustrative braided strand showing how component 26 may be embedded within the braided strand. As shown in FIG. 15, braided strand 80B may include strands 80. Strands 80 may include insulating strands and one or more conductive strands 80C. Strands 80 may be braided around electrical component 26. Electrical component 26 may be electrically connected to conductive strands 80C using solder 82 or other suitable conductive material.

In the example of FIG. 15, conductive strands 80C are inlaid strands in a triaxial or biaxial braid. Conductive strands 80C may extend parallel to longitudinal axis 182 of braided strand 80B. Braided strand 80B may be a tubular braid in which strands 80 form a braided covering (e.g., a sheath) around a hollow core (or a non-hollow core such as a metal core, plastic core, or other suitable core). The braided sheath may surround electrical component 26. Inlaid strands such as inlaid conductive strands 80C may be located in the covering without being braided around the core. This allows conductive strands 80C to follow a relatively straight path parallel to longitudinal axis 182 while other strands 80 are braided around axis 182.

The foregoing is merely illustrative and various modifications can be made by those skilled in the art without departing from the scope and spirit of the described embodiments. The foregoing embodiments may be implemented individually or in any combination.

What is claimed is:

1. Braiding equipment, comprising:

carriers having bobbins configured to dispense strands, wherein the carriers move the strands over and under one another to create a braid with the strands;

an insertion tool configured to insert an electrical component into the braid and to apply a force on the electrical component while the strands are braided around the electrical component, wherein the braid comprises a conductive strand; and a heating tool configured to reflow solder on the electrical component to form a solder connection between the electrical component and the conductive strand.

2. The braiding equipment defined in claim 1 wherein the conductive strand comprises an inlaid conductive strand and wherein the heating tool is configured to reflow the solder on the electrical component to form the solder connection between the electrical component and the inlaid conductive strand.

3. The braiding equipment defined in claim 1 further comprising a ring configured to hold a first portion of the strands at a first angle relative to the electrical component and to hold a second portion of the strands at a second angle relative to the carriers.

4. The braiding equipment defined in claim 3 wherein the ring comprises at least one of: an adjustable height and an adjustable diameter.

5. The braiding equipment defined in claim 1 wherein the carriers are configured to decrease a braiding speed as a diameter of the braid increases to accommodate the electrical component.

6. The braiding equipment defined in claim 1 wherein the insertion tool is configured to apply the force in a direction that is opposite a braiding direction of the strands.

7. A braided strand, comprising:

insulating strands that are braided together to form a tube;

a conductive strand surrounded by the tube; and an electrical component located in the tube and electrically coupled to the conductive strand, wherein the conductive strand comprises insulation that is locally removed to expose a conductive segment.

8. The braided strand defined in claim 7 wherein the conductive strand is an inlaid conductive strand.

9. The braided strand defined in claim 7 wherein the tube surrounds a hollow core.

10. The braided strand defined in claim 7 wherein the tube surrounds a metal core.

11. The braided strand defined in claim 7 wherein the tube surrounds a plastic core.

12. The braided strand defined in claim 7 wherein the conductive strand is one of multiple conductive strands surrounded by the tube.

13. The braided strand defined in claim 7 wherein the electrical component is soldered to the conductive strand.

14. The braided strand defined in claim 7 wherein the insulating strands are braided together in a triaxial braid.

15. The braided strand defined in claim 7 wherein the insulating strands are braided together in a biaxial braid.

* * * * *